US010585371B2

(12) United States Patent
Gilmartin et al.

(10) Patent No.: US 10,585,371 B2
(45) Date of Patent: Mar. 10, 2020

(54) PROTECTIVE COATINGS FOR BIAS CHARGE ROLLERS

(75) Inventors: Brian P. Gilmartin, Williamsville, NY (US); Liang-Bih Lin, Carlsbad, CA (US); Jeanne M. Koval, Marion, NY (US); Jin Wu, Pittsford, NY (US); Aaron M. Stuckey, Fairport, NY (US)

(73) Assignee: XEROX CORPORATION, Norwalk, CT (US)

( * ) Notice: Subject to any disclaimer, the term of this patent is extended or adjusted under 35 U.S.C. 154(b) by 1132 days.

(21) Appl. No.: 13/118,021

(22) Filed: May 27, 2011

(65) Prior Publication Data

US 2012/0301818 A1 Nov. 29, 2012

(51) Int. Cl.
*G03G 5/02* (2006.01)
*G03G 15/02* (2006.01)

(52) U.S. Cl.
CPC ..... *G03G 15/0233* (2013.01)

(58) Field of Classification Search
CPC ..... G11B 5/708; G11B 5/735; G11B 5/738; C08J 7/047
USPC ..... 428/323
See application file for complete search history.

(56) References Cited

U.S. PATENT DOCUMENTS

| | | | | |
|---|---|---|---|---|
| 5,248,553 | A * | 9/1993 | Miyashita et al. | 428/297.1 |
| 6,103,815 | A * | 8/2000 | Mammino et al. | 524/546 |
| 6,620,476 | B2 * | 9/2003 | Tarnawskyj et al. | 428/36.8 |
| 6,647,237 | B2 * | 11/2003 | Schlueter et al. | 399/307 |
| 2003/0113650 | A1 * | 6/2003 | Suwabe | G03G 9/0804 430/123.52 |
| 2007/0037903 | A1 * | 2/2007 | Swift | 523/218 |
| 2007/0087277 | A1 * | 4/2007 | Qi | C08G 8/10 430/58.55 |
| 2010/0104316 | A1 | 4/2010 | Hoshio et al. | |
| 2011/0123219 | A1 * | 5/2011 | Gilmartin et al. | 399/109 |

* cited by examiner

*Primary Examiner* — Samir Shah
(74) *Attorney, Agent, or Firm* — MH2 Technology Law Group LLP

(57) ABSTRACT

Exemplary embodiments provide materials and methods for an electrostatic charging member including a conductive substrate; a base layer disposed over the conductive substrate, the base layer comprising an elastomeric material and a semiconductive material; and a protective outer layer disposed over the base layer, the protective outer layer comprising a polymeric resin and a plurality of conductive particles, wherein the outer protective layer has a surface resistivity ranging from about $10^5$ O/sq to about $10^{13}$ O/sq.

19 Claims, 2 Drawing Sheets

PROTECTIVE COATINGS FOR BIAS CHARGE ROLLERS

FIELD OF USE

This disclosure relates generally to protective overcoat layers and, more particularly, to a protective overcoat layer for xerographic members, such as electrostatic charging members (e.g., bias charging members), and methods of making them.

BACKGROUND

In an electrophotographic printing apparatus, a conventional charging step can include applying a high voltage to a metal wire to generate a corona, which is then used for charging an electrophotographic photosensitive member. However, undesirable corona discharge products, such as ozone and $NO_x$, are generated along with the corona. Such corona discharge products can adversely affect the photosensitive member surface, causing deterioration in, image quality such as image blurring or fading or they presence of black streaks across copy sheets, and can be harmful to humans if released in relatively large quantities—for example, ozone.

An alternative to corona charging is direct charging, where a contact type charging device is used. The contact type charging device can include an electrostatic charging member, such as a bias charging member, which is supplied with voltage and charges the photosensitive member when in contact with the photosensitive member. As such, bias charging members require an outer layer having surface resistivity within a desired range. Materials with insufficient (too low) resistivity will cause shorting and/or unacceptably high current flow to the photosensitive member. Materials with excessive (too high) resistivity will require disproportionately high voltages for charging. Other problems can also result if the resistivity falls outside of a desired range, including nonconformance at the contact nip, poor toner releasing properties, and generation of contaminants during charging due to leaching from the photosensitive member. These adverse effects can result in the electrostatic charging member having non-uniform resistivity across the length of the contact member or resistivity that is susceptible to variations in temperature, relative humidity, running time, and/or contaminants.

Due to direct contact with the photosensitive member, a contact type charging device is also subject to increased stress and mechanical degradation, typically resulting in surface defects—for example scratches, streaks, abrasions, and pothole-like deformations—on the electrostatic charging member. Defects on the electrostatic charging member can translate to unfavorable print defects in the final product, such as dark streaking and white/dark spots. These failures reduce the useful lifetime of an electrostatic charging member, and ultimately reduce the useful lifetime of an electrophotographic printing apparatus.

Thus, there is a need to overcome these and other problems, of the prior art and to provide electrophotographic charging members with desirable surface resistivity and improved mechanical strength, and to extend charging member lifetime utility.

SUMMARY

In accordance with the various embodiments, there is provided an electrostatic charging member comprising a conductive substrate; a base layer disposed over the conductive substrate, the base layer comprising an elastomeric material and a semiconductive material; and a protective outer layer disposed over the base layer, the protective outer layer comprising a polymeric resin and a plurality of conductive particles, wherein the outer protective layer has a surface resistivity ranging from a bout $10^5$ Ω/sq to about $10^{13}$ Ω/sq.

According to various embodiments, there is provided a method of making an electrostatic charging member, the method comprising providing a conductive substrate; forming a base layer over the conductive substrate; and forming a protective outer layer over the base layer, the protective outer layer comprising a polymeric resin and a plurality of conductive particles, wherein the outer protective layer has a surface resistivity ranging from a bout $10^5$ Ω/sq to about $10^{13}$ Ω/sq.

Additional advantages of the embodiments will be set forth in part in the description which follows, and in part will be obvious from the description, or, may be learned by practice of the disclosure. The advantages will be realized and attained by means of the elements and combinations particularly pointed out in the appended claims.

It is to be understood that both the foregoing general description and the following detailed description are exemplary and explanatory only and are not restrictive of the disclosure, as claimed.

The accompanying drawings, which are incorporated in and constitute a part of this specification, illustrate embodiments of the disclosure and together with the description, serve to explain the principles of the disclosure.

DESCRIPTION OF THE EMBODIMENTS

Reference will now be made in detail to the present embodiments, examples of which are illustrated in the accompanying drawings. Wherever possible, the same reference numbers will be used throughout the drawings to refer to the same or like parts.

Notwithstanding that the numerical ranges and parameters setting forth the broad scope of the disclosure are approximations, the numerical values set forth in the specific examples are reported as precisely as possible. Any numerical value, however, inherently contains certain errors necessarily resulting from the standard deviation found in their respective testing measurements. Moreover, all ranges, disclosed herein are to be understood to encompass any and all sub-ranges subsumed therein. For example, a range of "less than 10" can include any and all sub-ranges, between (and including) the minimum value of zero and the maximum value of 10, that is, any and all sub-ranges having a minimum value of equal to or greater than zero and a maximum value of equal to or less than 10, e.g., 1 to 5. In certain cases, the numerical values as stated for the parameter can take on negative values. In this case, the example value of range stated as "less that 10" can assume negative values, e.g. −1, −2, −3, −10, −20, −30, etc.

Figure 1:
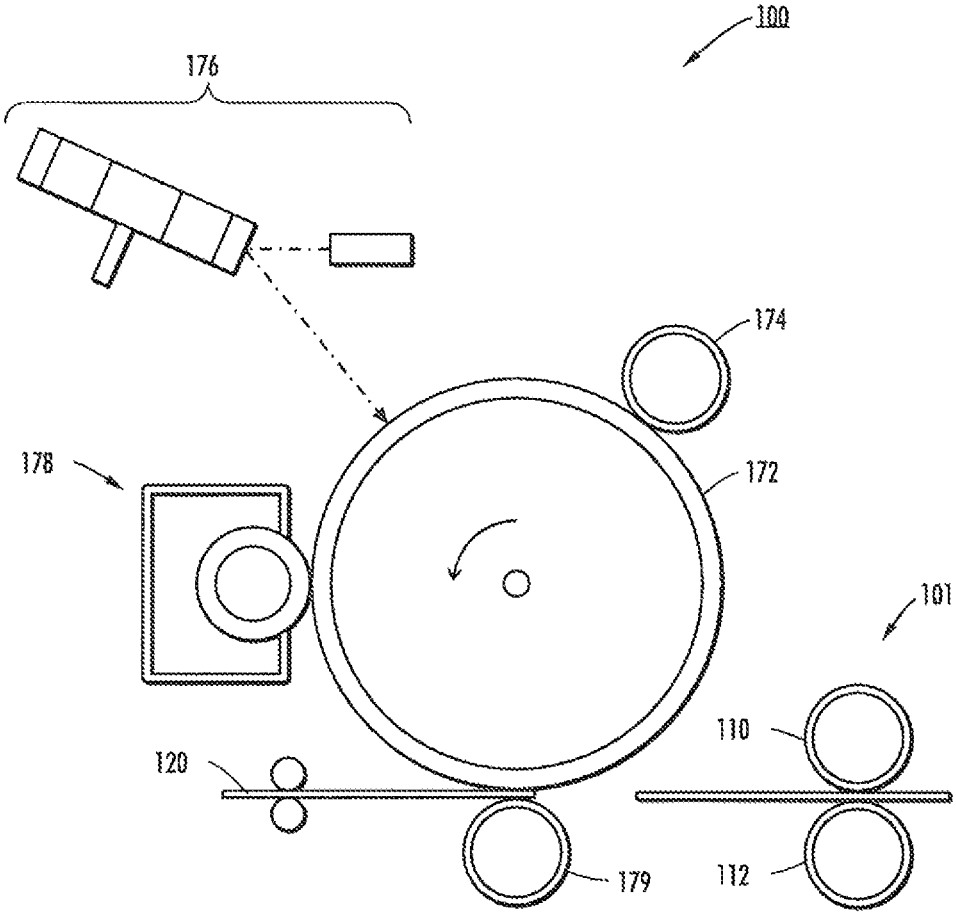
FIG. 1 schematically illustrates an exemplary printing apparatus, according to various embodiments of the present teachings.

FIG. 1 schematically illustrates an exemplary printing apparatus 100. The exemplary printing apparatus 100 can be a xerographic printer and can include an electrophotographic photoreceptor 172 and a charging station 174 for uniformly charging the electrophotographic photoreceptor 172. The charging station 174 can include an electrostatic charging member having a roll (cylinder) shape as show in FIG. 2 or a belt shape (not shown) or a sheet shape (not shown). The electrophotographic photoreceptor 172 can be a drum photoreceptor as shown in FIG. 1 or a belt photoreceptor (not shown). The exemplary printing apparatus 100 can also include an imaging station 176 where an original document (not shown) can be exposed to a light source (also not shown) for forming a latent image on the electrophotographic photoreceptor 172. The exemplary printing apparatus 100 can further include a development subsystem 178 for converting the latent image to a visible image on the electrophotographic photoreceptor 172 and a transfer subsystem 179 for transferring the visible image onto a media 120. The printing apparatus 100 can also include a fuser subsystem 101 for fixing the visible image onto the media 120. The fuser subsystem 101 can include one or more of a fuser member 110, a pressure member 112, oiling subsystems (not shown), and a cleaning web (not shown).

Figure 2:
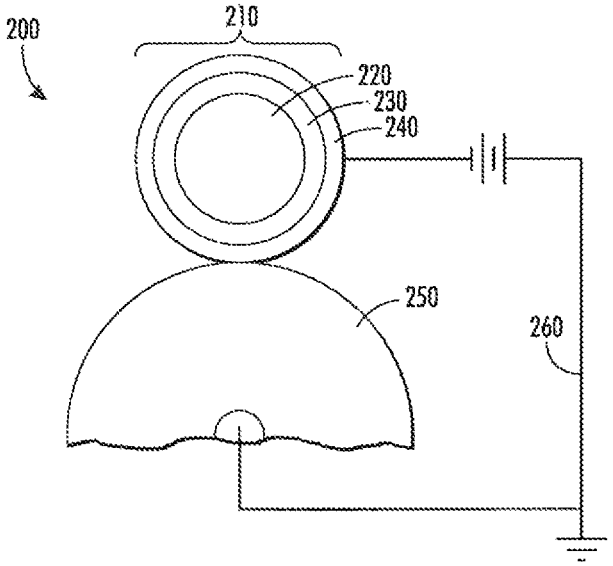
FIG. 2 schematically illustrates a cross section of an exemplary charging station, according to various embodiments of the present teachings.
Figure 3:
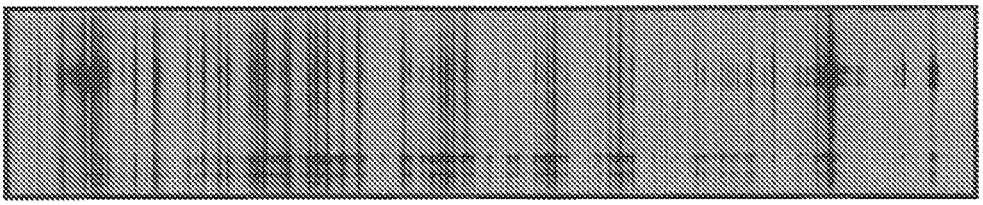
FIG. 3 shows a scanned image print output from an electrostatic charging member without the disclosed embodiments of the present teachings.

FIG. 2 schematically illustrates a cross section of an exemplary charging station 200, in accordance with various embodiments of the present teachings. The charging station 200 can include an exemplary electrostatic charging member 210 coupled to a high voltage power supply 260. The bias charge roller 210 can be in contact with the photoreceptor 172 to uniformly charge the photoreceptor 172.

The electrostatic charging member 210 may take any suitable form including but not limited to roll, drum, belt, and the like. In an aspect, the electrostatic charging member 210 can be a roll, such as a bias charge roller (BCR). The electrostatic charging member 210 can include a conductive substrate (core) 220. The conductive substrate 220 may have a diameter of from, for example, about 1 mm to about 50 mm, although larger or smaller diameters may be used as desired. The conductive substrate 220 can be made of any suitable durable materials, for example metal (such as aluminum, steel, and the like), or a conductive polymer, or an insulative polymer having surface coating of metal such as copper, nickel, and the like.

The electrostatic charging member 210 can include a protective outer layer 240 disposed over the conductive core 220. Optionally, a base layer 230 can be disposed between the conductive core 220 and the protective outer layer 240, as shown in FIG. 1. Although shown as one layer, it is possible to omit the base layer 230 or have multiple base layers. If included, the base layer 230 can include any elastomeric material and a semiconductive material, as discussed below. In non-limiting embodiments, the elastomeric material can include isoprenes, chloroprenes, epichlorohydrins, butyl elastomers, polyurethanes, silicone elastomers, fluorine elastomers, styrene-butadiene elastomers, butadiene elastomers, nitrile elastomers, ethylene propylene elastomers, epichlorohydrin-ethylene oxide copolymers, epichlorohydrin-ethylene oxide-allyl glycidyl ether copolymers, ethylene-propylene-diene (EPDM) elastomers, acrylonitrile-butadiene copolymers (NBR), natural rubber, and the like, and combinations thereof. In an aspect, the elastomeric material can be polyurethane, silicone elastomers, EPDM, NBR, epichlorohydrin-ethylene oxide copolymers, epichlorohydrin-ethylene oxide-allyl glycidyl ether copolymers, and the like, and combinations thereof.

Any semiconductive material can be included with the elastomeric material. In embodiments, the semiconductive material can include, but is not limited to, carbon black, pyrolytic carbon, graphite, metal oxides, doped metal oxides, metal alloys, conductive polymers, chlorates or perchlorates of tetraethylammonium and/or lauryltrimethyl ammonium, salts of alkali or alkaline-earth metals, and the like, and combinations thereof.

The base layer 230 may be formed according to any suitable manner known in the art. For instance, a general mixing method of blending all ingredients beforehand in a tumbler, a V-blender, or the like, and subjecting the resulting mixture to homogeneous melt blending by use of an extruder can be used. The extruded melt mixture may be coated on the conductive core 220 according to any suitable manner known in the art. Optionally, the base layer 230 may be attached to the conductive core 220 with an adhesive.

The amount of elastomeric material in the base layer 230 can range from about 70 to about 99 percent by weight, such as from about 75 to about 90 percent by weight or about 80 to about 85 percent by weight, relative to the total weight of the base layer. The amount of semiconductive material in the base layer 230 can range from about 1 to about 30 percent by weight, such as from about 10 to about 25 percent by weight, such as from about 15 to about 20 percent by weight, relative to the total weight of the base layer. The base layer 230 can have a thickness of from about 10 mm to about 20 cm, for example from about 50 mm to about 3 cm.

A protective outer layer 240 can be disposed over the conductive core 220 or over the base layer 230. The protective outer layer 240 can include a polymeric resin and a conductive particle, where the resin can be thermoplastic or thermoset. In embodiments, the resin can include, but is not limited to polyurethane, polyurea, polyolefin, polyester, polyimide, polyamide, polycarbonate, phenolic resins, aminoplast resins, copolymers derived from conjugated diene monomers, vinyl aromatic monomers, and/or ethylenically unsaturated nitrile monomers; and the like, and combinations thereof.

In an aspect, copolymers derived from conjugated diene monomers, vinyl aromatic monomers, and/or ethylenically unsaturated nitrile monomers can include styrene-butadiene (SB) copolymers, acrylonitrile-butadiene (NBR) copolymers, acrylonitrile-butadiene-styrene (ABS) terpolymers, and the like, and combinations thereof. In a particular aspect, the resin can be a thermoplastic acrylonitrile-butadiene-styrene (ABS) terpolymer. Acrylonitrile may comprise from about 15 to about 35 wt % of the ABS terpolymer. Butadiene may comprise from about 5 to about 30 wt % of the ABS terpolymer. Styrene may comprise from about 40 to about 60 wt % of the ABS terpolymer. A commercially available example of ABS copolymers includes, for example, Blendex® 200 from Chemtura Corp. of Middlebury, Conn.

Various polyurethanes can suitably be used herein as the thermoplastic or thermoset resin. In embodiments, suitable polyurethanes can be derived from polyacrylates and polyisocyanates. For example, suitable polyurethanes can include, but are not limited to, reaction products of polyaspartic acid ester and isocyanate ("2K urethane"); reaction products of hydroxy-functional polyacrylates and isocyanate; and the like, and combinations thereof. Commercially available examples of polyacrylates include Desmophen® NH 1120 and Desmophen® A 450 BA (Bayer Material Science AG of Leverkusen, Germany). Commercially available examples of isocyanates include Desmodur® BL 3175A (Bayer Material Science AG of Leverkusen, Germany).

Various polyesters can suitably be used herein as the thermoplastic resin. In embodiments, suitable polyesters include thermoplastic polycaprolactones. In an aspect, the thermoplastic polycaprolactones can have a weight average molecular weight ranging from about 10,000 to about 80,000, such as from about 20,000 to about 50,000, such as from about 25,000 to about 45,000. Commercially available examples of thermoplastic polycaprolactones include Capa® 6250 and Capa® 6100 (Perstorp AB of Perstorp, Sweden and sold by Perstorp USA of Toledo, Ohio).

Various phenolic resins can be used herein as the thermoset resin. As used herein, "phenolic resins" refers to condensation products of an aldehyde with a phenol source in the presence of an acidic or basic catalyst.

The phenol source can be, for example, phenol, alkyl-substituted phenols such as cresols and xylenols; halogen-substituted phenols such as chlorophenol; polyhydric phenols such as resorcinol or pyrocatechol; polycyclic phenols such as naphthol and bisphenol A; aryl-substituted phenols; cyclo-alkyl-substituted phenols; aryloxy-substituted phenols; and the like, and combinations thereof. In various aspects, the phenol source can be phenol, 2,6-xylenol, o-cresol, p-cresol, 3,5-xylenol, 3,4-xylenol, 2,3,4-trimethyl phenol, 3-ethyl phenol, 3,5-diethyl phenol, p-butyl phenol, 3,5-dibutyl phenol, p-amyl phenol, p-cyclohexyl phenol, p-octyl phenol, 3,5-dicyclohexyl phenol, p-phenyl phenol, p-crotyl phenol, 3,5-dimethoxy phenol, 3,4,5-trimethoxy phenol, p-ethoxy phenol, p-butoxy phenol, 3-methyl-4-methoxy phenol, p-phenoxy phenol, multiple ring phenols such as bisphenol A, and combinations thereof.

The aldehyde for use in making the phenolic resin can be, for example, formaldehyde, paraformaldehyde, acetaldehyde, butyraldehyde, paraldehyde, glyoxal, furfuraldehyde, propinonaldehyde, benzaldehyde, and combinations thereof. In various aspects, the aldehyde can be formaldehyde.

Non-limiting examples of phenolic resins include dicyclopentadiene type phenolic resins, phenol novolak resins, cresol novolak resins, phenol aralkyl resins, and combinations thereof. Other non-limiting examples of phenolic resins include alcohol-soluble resol-type phenolic resins such as PHENOLOTE® J-325 (DIC Corp. of Tokyo, Japan); formaldehyde polymers with phenol, p-tert-butylphenol, and cresol, such as VARCUM™ 29159 and 29101 (OxyChem Co.) and DURITE® 97 (Borden Chemical); or formaldehyde polymers with ammonia, cresol, and phenol, such as VARCUM® 29112 (OxyChem Co.); or formaldehyde polymers with 4,4'-(1-methylethylidene)bisphenol such as VARCUM® 29108 and 29116 (OxyChem Co.); or formaldehyde polymers with cresol and phenol such as VARCUM™ 29457 (OxyChem Co.), DURITE® SD-423A, SD-422A (Borden Chemical); or formaldehyde polymers with phenol and p-tert-butylphenol such as DURITE® ESD 556C (Border Chemical).

In aspects, the phenolic resins can be used as-is or they can be modified. For example, the phenolic resins can be modified with suitable plasticizers, e.g. including but not limited to polyvinyl butyral, nylon resins, thermoset acrylic resins, polyvinyl formal, alkyds, epoxy resins, phenoxy resins (bisphenol A, epichlorohydrin polymer, and the like), polyamides, polyacrylates, oils, and the like, and combinations thereof. Various modifiers are known under various trade names, including but not limited to DESMOPHEN®, DESMODUR®, BUTVAR®, ELVAMIDE®, DORESCO®, SILCLEAN®, and PARALOID®.

As used herein, "aminoplast resin" refers to amino resins made from a nitrogen-containing substance and formaldehyde, wherein the nitrogen-containing substance includes melamine, urea, benzoguanamine, and glycoluril. The aminoplast resins can be highly alkylated or partially alkylated. In aspects, the aminoplast resins can be used as-is or they can be modified. For example, the aminoplast resins can be modified with suitable plasticizers, e.g. including but not limited to polyvinyl butyral, nylon resins, thermoset'acrylic resins, polyvinyl formal, alkyds, epoxy resins, phenoxy resins (bisphenol A, epichlorohydrin polymer, and the like), polyamides, polyacrylates, oils, and the like, and combinations thereof. Various modifiers are known under various trade names, including but not limited to DESMOPHEN®, DESMODUR®, BUTVAFR®, ELVAMIDE®, DORESCO®, SILCLEAN®, and PARALOID®.

If melamine is used, the resulting resin is also known as a "melamine resin". Melamine resins are known under various trade names, including but not limited to CYMEL®, BEETLE®, DYNOMIN®, BECKAMINE®, UFR®, BAKELITE®, ISOMIN®, MELAICAR®, MELBRITE®, MELMEX®, MELOPAS®, RESART®, and ULTRAPAS®.

In aspects, the melamine resin can have a generic formula of

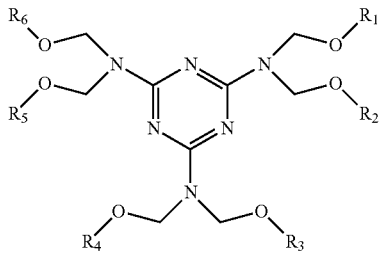

in which $R_1$, $R_2$, $R_3$, $R_4$, $R_5$ and $R_6$ each independently represents a hydrogen atom or an alkyl chain with 1 to 8 carbon atoms, or with 1 to 4 carbon atoms.

The melamine resin can be water-soluble, dispersible or indispersible. In various aspects, the melamine resin can be highly alkylated/alkoxylated, partially alkylated/alkoxylated, or mixed alkylated/alkoxylated. In various aspects, the melamine resin can be methylated, n-butylated or isobutylated. In other aspects, the melamine resin can have low methylol and high imino content. In embodiments, the melamine resin can be described as oligomeric in nature with methoxymethyl and imino main functionalities. Non-limiting examples of the melamine resin can include methylated high imino melamine resins (partially methylolated and highly alkylated) such as CYMEL® 323, 325, 327, 328, 385; highly methylated melamine resins such as CYMEL® 350, 9370; partially methylated melamine resins (highly methylolated and partially methylated) such as CYMEL® 373, 370; high solids mixed ether melamine resins such as CYMEL® 1130, 324; n-butylated melamine resins such as CYMEL™ 1151, 615; n-butylated high imino melamine resins such as CYMEL® 1158; iso-butylated melamine resins such as CYMEL® 255-10. CYMEL® melamine resins are commercially available from Cytec Industries Inc. of Woodland Park, N.J.

In aspects, the melamine resin can be selected from methylated formaldehyde-melamine resin, methoxymethylated melamine resin, ethoxymethylated melamine resin, propoxymethylated melamine resin, butoxymethylated melamine resin, hexamethylol melamine resin, alkoxyalkylated melamine resins such as methoxymethylated melamine resin, ethoxymethylated melamine resin, propoxymethylated melamine resin, butoxymethylated melamine resin, and mixtures thereof.

If urea is used, the resulting resin is also known as a "urea resin". Urea resins are known under various trade names, including but not limited to CYMEL® BEETLE® DYNOMIN® BECKAMINE® and AMIREME®.

In aspects, the urea resin can have a generic formula of

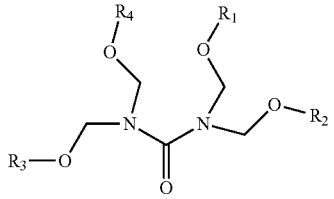

in which $R_1$, $R_2$, $R_3$, and $R_4$ each independently represents a hydrogen atom or an alkyl chain with 1 to 8 carbon atoms, or with 1 to 4 carbon atoms.

In aspects, the urea resin can be water-soluble, dispersible or indispersible. In various aspects, the urea resin can be highly alkylated/alkoxylated, partially alkylated/alkoxylated, or mixed alkylated/alkoxylated. In various aspects, the urea resin can be methylated, n-butylated or isobutylated. Non-limiting examples of the urea resin include methylated urea resins such as CYMEL® U-65, U-382; n-butylated urea resins such as CYMEL® U-1054, UB-30-B; iso-butylated urea resins such as CYMEL® U-662, UI-19-I. CYMEL® urea resins are commercially available from Cytec Industries Inc. of Woodland Park, N.J.

If benzoguanamine is used, the resulting resin is also known as a "benzoguanamine resin". Benzoguanamine resins are known under various trade names, including but not limited to CYMEL®, BEETLE®, and UFORMITE®.

In aspects, the benzoguanamine resin can have a generic formula of

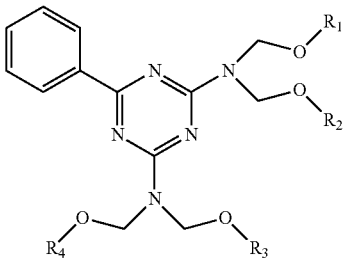

in which $R_1$, $R_2$, $R_3$, and $R_4$ each independently represents a hydrogen atom or an alkyl chain with 1 to 8 carbon atoms, or with 1 to 4 carbon atoms.

The benzoguanamine resin can be water-soluble, dispersible or indispersible. In various aspects, the benzoguanamine resin can be highly alkylated/alkoxylated, partially alkylated/alkoxylated, or mixed alkylated/alkoxylated. In various aspects, the benzoguanamine resin can be methylated, n-butylated or isobutylated. Non-limiting examples of the benzoguanamine resin include CYMEL™ 659, 5010, 5011. CYMEL® benzoguanamine resins are commercially available from Cytec Industries Inc. of Woodland Park, N.J.

If glycouracil is used, the resulting resin is also known as a "glycoluril resin". Glycoluril resins are known under various trade names, including but not limited to CYMEL®, and POWDERLINK®.

In, aspects, the glycoluril resin can have a generic formula of

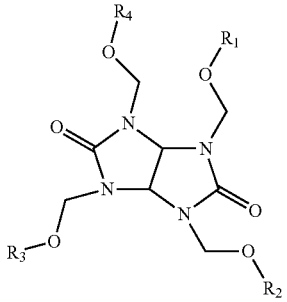

in which $R_1$, $R_2$, $R_3$, and $R_4$ each independently represents a hydrogen atom or an alkyl chain with 1 to 8 carbon atoms, or with 1 to 4 carbon atoms.

The glycoluril resin can be water-soluble, dispersible or indispersible. In various aspects, the glycoluril resin can be highly alkylated/alkoxylated, partially alkylated/alkoxylated, or mixed alkylated/alkoxylated. In various aspects, the glycoluril resin can be methylated, n-butylated or isobutylated. Non-limiting examples of the glycoluril resin include CYMEL® 1170, 1171. CYMEL® glycoluril resins are commercially available from Cytec Industries Inc. of Woodland Park, N.J.

The protective outer layer 240 can further include a conductive particle with the polymeric resin. The conductive particle can be the same or different than the semiconductive material in the base layer 230. In embodiments, the conductive particle can include, but is not limited to, carbon black, pyrolytic carbon, graphite, metal oxides, doped metal oxides, metal alloys, conductive polymers, chlorates or perchlorates of tetraethylammonium and/or lauryltrimethyl ammonium, salts of alkali or alkaline-earth metals, and the like, and combinations thereof. In an aspect, the conductive particle can be carbon black; polypyrrole; polythiophene; polyacetylene; metal oxides such as tin oxide, indium oxide, titanium oxide, and the like; doped metal oxides such as tin oxide-antimony oxide solid solution, antimony-doped titanium oxide, iron-doped titanium oxide, and the like; polyaniline; poly(3,4-ethylenedioxythiophene)polyethylene glycol (PEDOT-PEG) block copolymers; poly(3,4-ethylenedioxythiophene)poly(styrenesulfonate) (PEDOT-PSS) polymers; and the like, and combinations thereof. Commercially available examples of semiconductive materials suitable for use herein include, but are not limited to, VULCAN® XC72 carbon black, EVONIK® FW-1 carbon black, and PANIPOL® F polyaniline.

The amount of polymeric resin in the protective outer layer 240 can range from about 40 to about 99 percent by weight, such as from about 50 to about 90 percent by weight or about 60 to about 85 percent by weight, relative to the total weight of the protective outer layer. The amount of conductive particle in the protective outer layer 240 can range from about 1 to about 60 percent by weight, such as from about 10 to about 50 percent by weight, such as from about 15 to about 40 percent by weight, relative to the total weight of the base layer. The protective outer layer 240 can have a thickness of from about 1 μm to about 100 μm, for example from about 3 μm to about 40 μm or about 4 μm to about 20 μm.

The disclosed exemplary electrostatic charging members 200 including a protective outer layer 240 disposed over the conductive core 220 or base layer 230 are believed to have improved mechanical properties at appropriate charging resistivities as compared to conventional BCR members without the protective outer layer 240. In embodiments, the protective outer layer 240 can have a surface conductivity ranging from about $10^5$ Ω/sq to about $10^{13}$ Ω/sq, such as from about $10^6$ Ω/sq to about $10^{10}$ Ω/sq, for example from about $10^7$ Ω/sq to about $10^8$ Ω/sq. Without being limited by theory, it is believed that the protective outer layer provides improved mechanical strength while retaining the resistivity and charge uniformity necessary for optimal BCR performance. Electrostatic charging members having insufficient (too low) resistivity will cause shorting and/or unacceptably high current flow to the photosensitive member. Electrostatic charging members with excessive (too high) resistivity will require disproportionately high voltages for charging. Additionally, if the resistivity falls outside of the desired range, other problems can surface such as nonconformance at the contact nip (i.e., the contact area where BCR meets photosensitive member), poor toner releasing properties, and generation of contaminants during charging due to leaching from the photosensitive member. These adverse effects can result in the electrostatic charging member having non-uniform resistivity across the length of the contact member or resistivity that is susceptible to variations in temperature, relative humidity, running time, and/or contaminants, all of which is problematic. BCRs having the disclosed protective outer layer 240 can avoid many or all of these adverse effects.

The protective outer layer 240 can be prepared from a dispersion including the elastomeric material and conductive particle. The dispersion can be formed by any known method known the art such as milling (e.g., ball milling) for a suitable amount of time (e.g., several days). The dispersion can be filtered and coated on the conductive core 220 or the base layer 230 according to any suitable manner known in the art, e.g., dip coating, flow coating, spray coating, roll coating, ring coating, die casting, rotary atomizing, and the like, and cured at a temperature of about 25° C. to about 200° C., or from about 100° C. to about 160° C. for about 20 to about 120 minutes, or from about 30 to about 60 minutes, to form the protective outer layer 240. The protective outer layer can have a thickness of from about 1 μm to about 100 μm, or from about 2 μm to about 50 μm, such as from about 3 μm to about 20 μm.

According to various embodiments, there is an exemplary method of making an electrostatic charging member 210. The method can include a step of providing a conductive substrate, a step of forming a base layer over the conductive substrate, and a step of forming a protective outer layer over the base layer. In various embodiments, the electrostatic charging member can include a substrate having any suitable shape, such as, for example, a roll (cylinder), belt or sheet. The base layer can include an elastomeric material and a semiconductive material. The protective outer layer can include a polymeric resin and a conductive particle. In various embodiments, the step of forming a protective outer layer can include melt blending the polymeric resin and conductive particle to form a mixture and melt extruding the mixture over the conductive core 220 or the base layer 230. However, any other suitable methods of melt blending and melt extruding can be used.

EXAMPLES

Dispersions were prepared by ball milling a polymeric resin dissolved in a solvent or mixture of solvents, and a conductive particle, for several days. The types and amounts of polymeric resin and conductive particle are as indicated in Table 1. After milling, the dispersions were filtered through a 20 μm filter and thinly coated on a polyethylene terephthalalate (PET) sheet. Surface resistivity of the coated PET sheet was determined using a Hiresta UP Resistivity Meter as indicated in Table 1. The dispersions were then coated on Imari™ BCRs using a Tsukiage coater to give the thicknesses indicated in Table 1, and cured at 150° C. for 40 minutes.

TABLE 1

| BCR | Polymer | Conductive Particle | Loading of Conductive Particle | Surface Resistivity (O/□) | Overcoat Thickness (μm) |
|---|---|---|---|---|---|
| 1 | Blendex 200 ABS copolymer | Vulcan XC72 carbon black | 14% | $1.0 \times 10^7$ | 6 |
| 2 | Blendex 200 | Vulcan XC72 | 12% | $1.0 \times 10^{12}$ | 6 |
| 3 | PcZ 400 polycarbonate | Vulcan XC72 | 5% | $1.0 \times 10^{13}$ | 6 |
| 4 | J-325 Phenolicpolymer | Vulcan XC72 | 5% | $1.2 \times 10^8$ | 5 |
| 5 | Blendex 200 | Sb-doped $TiO_2$ | 50% | $1.0 \times 10^7$ | 6 |
| 6 | Blendex 200 | Fe-doped $TiO_2$ | 50% | $1.0 \times 10^{13}$ | 6 |
| 7 | Blendex 200 | $TiO_2$ | 50% | $1.0 \times 10^{10}$ | 6 |
| 8 | Blendex 200 | PanipolF polyaniline | 20% | $3.2 \times 10^9$ | 6 |
| 9 | 1:1 Desmophen NH 1220 polyaspartic acid ester/DesmodurBL3175A isocyanate | Vulcan XC72 | 5% | $9.1 \times 10^8$ | 3.5 |
| 10 | 1:1 Desmophen A 450 BA/X polyacrylate/ DesmodurBL3175A | Vulcan XC72 | 4% | $1.6 \times 10^6$ | 6 |
| 11 | CAPA 6250 polycaprolactone | Vulcan XC72 | 5% | $1.6 \times 10^6$ | 8 |
| 12 | CAPA 6100 polycaprolactone | Vulcan XC72 | 5% | $2.1 \times 10^6$ | 8 |
| 13 | Extem XH1005 thermoplasticpolyimide | FW 1 carbon black | 10% | $5.7 \times 10^6$ | 6 |
| 14 | 1:1 B-98 polyvinylbutyral/Cymel325 melamine | Vulcan XC72 | 20% | $1.2 \times 10^5$ | 6 |
| 15 | 94:5:5:5 Cymel325/Elvamide 8061 nybn resin | SC9773 carbon black | 6% | $7.5 \times 10^5$ | 6 |
| 16 | 65:35 DorescoTA 228 acrylic resin/Cymel1170 glycolinlw/2% p-TSA and 1% Silclean 3700 | Vulcan XC72 | 4% | $6.0 \times 10^7$ | 6 |
| 17 | 1:1 Cymel325/AT-410 | PEDOT-block-PEG | 2.5% | $1.0 \times 10^{11}$ | 4 |

As illustrated in Table 2, each of the coated BCRs displayed excellent charge uniformity. Relative to the average charging observed from uncoated BCRs (controls), each of the Inventive Examples displayed comparable charging capability. No significant fluctuations were observed with any of the Inventive Examples, nor were any torque-associated issued observed.

TABLE 2

| BCR | Avg Charge Uniformity; t = 0 (V) | Avg Charge Uniformity*; t = 50k (V) | Control Avg Charge Uniformity*; t = 0 (V) | Control Avg Charge Uniformity*; t = 50k (V) |
|---|---|---|---|---|
| 1 | 709 | 727 | 715 | 739 |
| 2 | 719 | 736 | " | " |
| 3 | 727 | 754 | " | " |
| 4 | 740 | 745 | " | " |
| 5 | 730 | 746 | " | " |
| 6 | 711 | 721 | " | " |
| 7 | 760 | 772 | " | " |
| 8 | 761 | 681 | " | " |
| 9 | 652 | 675 | 626 | 609 |
| 10 | 658 | 642 | " | " |
| 11 | 686 | 659 | 715 | 739 |
| 12 | 674 | 635 | " | " |
| 13 | 705 | 713 | 622 | 647 |
| 14 | 790 | 790 | 590 | 612 |
| 15 | 724 | 726 | " | " |
| 16 | 634 | 725 | " | " |
| 17 | 615 | 583 | " | " |

*Control Avg Charge Uniformity was obtained from a BCR with no coating

For stress testing, each of the Inventive BCRs were subjected to 50 k cycle wear on a Hodaka fixture. Prints were then obtained by equipping either a Pinehurst or an Imperia machine with the stress tested BCRs. All of the Inventive BCRs were able to eliminate dark streaking, which was only observed from printing with a non-coated BCR after stress testing.

While the disclosure has been illustrated respect to one or more implementations, alterations and/or modifications can be made to the illustrated examples without departing from the spirit and scope of the appended claims. In addition, while a particular feature of the disclosure may have been disclosed with respect to only one of several implementations, such feature may be combined with one or more other features of the other implementations as may be desired and advantageous for any given or particular function. Furthermore, to the extent that the terms "including", "includes", "having", "has", "with", or variants thereof are used in either the detailed description and the claims, such terms are intended to be inclusive in a manner similar to the term "comprising." As used herein, the term "one or more of" with respect to a listing of items such as, for example, A and B, means A alone, B alone, or A and B.

Other embodiments of the disclosure will be apparent to those skilled in the art from consideration of the specification and practice of the disclosure herein. It is intended that the specification and examples be considered as exemplary only, with a true scope and spirit of the disclosure being indicated by the following claims.

What is claimed is:

1. An electrostatic charging member comprising:

a conductive substrate;

a base layer disposed over the conductive substrate, the base layer comprising an elastomeric material and a semiconductive material; and a protective outer layer disposed over the base layer, the protective outer layer comprising a polymeric resin and a plurality of conductive particles, the plurality of conductive particles being selected from the group consisting of tin oxide, indium oxide, titanium oxide, doped metal oxides, metal alloys, conductive polymers, and combinations thereof, wherein the outer protective layer has a surface resistivity ranging from about $10^5$ Ω/sq to about $10^{13}$ Ω/sq; and wherein the polymeric resin is selected from the group consisting of polyester, phenolic resins, aminoplast resins; and combinations thereof, wherein if the polymeric resin includes a polyester, the polyester is a thermoplastic polycaprolactone;

wherein if the polymeric resin includes a phenolic resin, the phenolic resin is a condensation product of an aldehyde with a phenol source in the presence of an acidic or basic catalyst, the phenolic resin being optionally modified with a plasticizer; and wherein if the polymeric resin includes an aminoplast resin, the aminoplast resin is made from ingredients comprising a nitrogen-containing substance and formaldehyde, the nitrogen-containing substance being chosen from one of urea, benzoguanamine and glycoluril, the aminoplast resin being optionally alkylated, and the aminoplast resin being optionally modified with a plasticizer.

2. The electrostatic charging member of claim 1, wherein the conductive polymer is selected from the group consisting of polyaniline, polythiophene, polypyrrole, PEDOT/PSS polymers, PEDOT/PEG block copolymers, and combinations thereof.

3. The electrostatic charging member of claim 1, wherein the plurality of conductive particles is present in an amount ranging from about 1 weight percent to about 60 weight percent, relative to the total solids content of the protective outer layer.

4. The electrostatic charging member of claim 1, wherein the plurality conductive particles is present in an amount ranging from about 10 weight percent to about 50 weight percent, relative to the total solids content of the protective outer layer.

5. The electrostatic charging member of claim 1, wherein the outer protective layer has a thickness ranging from about 1 μm to about 100 μm.

6. The electrostatic charging member of claim 1, wherein the outer protective layer has a thickness ranging from about 3 μm to about 50 μm.

7. The electrostatic charging member of claim 1, wherein the outer protective layer has a thickness ranging from about 4 μm to about 20 μm.

8. The electrostatic charging member of claim 1, wherein the elastomeric material is selected from the group consisting of isoprenes, chloroprenes, epichlorohydrins, butyl elastomers, polyurethanes, silicone elastomers, fluorine elastomers, styrene-butadiene elastomers, butadiene elastomers, nitrile elastomers, ethylene propylene elastomers, epichlorohydrin-ethylene oxide copolymers, epichlorohydrin-ethylene oxide-allyl glycidyl ether copolymers, ethylene-propylene-diene terpolymers, acrylonitrile-butadiene rubbers, natural rubber, and combinations thereof.

9. An electrostatic charging device comprising:

an electrostatic charging member comprising a conductive substrate, a base layer, and a protective outer layer disposed over the base layer, the protective outer layer comprising a polymeric resin and a plurality of conductive particles, the plurality of conductive particles being selected from the group consisting of tin oxide, indium oxide, titanium oxide, doped metal oxides, metal alloys, conductive polymers, and combinations thereof, wherein the outer protective layer has a surface resistivity ranging from about $10^5$ Ω/sq to about $10^{13}$ Ω/sq, and wherein the polymeric resin is selected from the group consisting of phenolic resins, aminoplast resins; copolymers derived from conjugated diene monomers, vinyl aromatic monomers, and ethylenically unsaturated nitrile monomers; and combinations thereof, with the proviso that if the polymeric resin is a copolymer derived from conjugated diene monomers, vinyl aromatic monomers, and ethylenically unsaturated nitrile monomers, then the plurality of conductive particles are selected from the group consisting of antimony-doped titanium oxide, iron-doped titanium oxide and polyaniline, wherein if the polymeric resin includes a phenolic resin, the phenolic resin is a condensation product of an aldehyde with a phenol source in the presence of an acidic or basic catalyst, the phenolic resin being optionally modified with a plasticizer;

wherein if the polymeric resin includes an aminoplast resin, the aminoplast resin is made from ingredients comprising a nitrogen-containing substance and formaldehyde, the nitrogen-containing substance being chosen from one of melamine, urea, benzoguanamine and glycoluril, the aminoplast resin being optionally alkylated, and the aminoplast resin being optionally modified with a plasticizer; and wherein if the nitrogen-containing substance includes melamine, then the melamine is a methylated high imino melamine resin and the plurality of conductive particles are poly(3,4-ethylenedioxythiophene) polyethylene glycol (PEDOT-PEG) block copolymers.

10. The electrostatic charging device according to claim 9, wherein the conductive substrate has a shape selected from the group consisting of a cylinder, a belt, and a sheet.

11. The electrostatic charging member of claim 9, wherein the polymeric resin is a copolymer derived from conjugated diene monomers, vinyl aromatic monomers, and ethylenically unsaturated nitrile monomers.

12. An electrostatic charging member comprising:

a conductive substrate;

a base layer disposed over the conductive substrate, the base layer comprising an elastomeric material and a semiconductive material; and a protective outer layer disposed over the base layer, the protective outer layer comprising a polymeric resin and a plurality of conductive particles, the plurality of conductive particles being selected from the group consisting of carbon black, pyrolitic carbon, graphite, tin oxide, indium oxide, titanium oxide, doped metal oxides, metal alloys, conductive polymers, and combinations thereof, wherein the outer protective layer has a surface resistivity ranging from about $10^5$ Ω/sq to about $10^{13}$ Ω/sq, and wherein the polymeric resin is selected from the group consisting of phenolic resins, aminoplast resins; copolymers derived from conjugated diene monomers, vinyl aromatic monomers, and ethylenically unsaturated nitrile monomers; and combinations thereof, with the proviso that if the polymeric resin is a copolymer derived from conjugated diene monomers, vinyl aromatic monomers, and ethylenically unsaturated nitrile monomers, then the plurality of conductive particles are selected from the group consisting of antimony-doped titanium oxide, iron-doped titanium oxide and polyaniline, wherein if the polymeric resin includes a phenolic resin, the phenolic resin is a condensation product of an aldehyde with a phenol source in the presence of an acidic or basic catalyst, the phenolic resin being optionally modified with a plasticizer; and wherein if the polymeric resin includes an aminoplast resin, the aminoplast resin is made from ingredients comprising a nitrogen-containing substance and formaldehyde, the nitrogen-containing substance being chosen from one of urea, benzoguanamine and glycoluril, the aminoplast resin being optionally alkylated, and the aminoplast resin being optionally modified with a plasticizer.

13. The electrostatic charging member of claim 12, wherein the conductive particles are carbon black.

14. The electrostatic charging member of claim 13, wherein the polymeric resin is a copolymer derived from conjugated diene monomers, vinyl aromatic monomers, and ethylenically unsaturated nitrile monomers.

15. The electrostatic charging member of claim 13, wherein the polymeric resin is a copolymer selected from the group consisting of acrylonitrile-butadiene (NBR) copolymers and acrylonitrile-butadiene-styrene (ABS) terpolymers.

16. The electrostatic charging member of claim 13, wherein the polymeric resin is a thermoplastic acrylonitrile-butadiene-styrene (ABS) terpolymer.

17. The electrostatic charging member of claim 16, wherein the thermoplastic acrylonitrile-butadiene-styrene (ABS) terpolymer comprises Acrylonitrile units in an amount ranging from about 15 to about 35 wt % of the ABS terpolymer; Butadiene units in an amount ranging from about 5 to about 30 wt % of the ABS terpolymer; and Styrene units in an amount ranging from about 40 to about 60 wt % of the ABS terpolymer.

18. The electrostatic charging member of claim 12, wherein the polymeric resin is a thermoplastic acrylonitrile-butadiene-styrene (ABS) terpolymer.

19. The electrostatic charging member of claim 18, wherein the thermoplastic acrylonitrile-butadiene-styrene (ABS) terpolymer comprises Acrylonitrile units in an amount ranging from about 15 to about 35 wt % of the ABS terpolymer; Butadiene units in an amount ranging from about 5 to about 30 wt % of the ABS terpolymer; and Styrene units in an amount ranging from about 40 to about 60 wt % of the ABS terpolymer.

* * * * *